US009618289B1

(12) United States Patent
Geissele

(10) Patent No.: US 9,618,289 B1
(45) Date of Patent: Apr. 11, 2017

(54) TRIGGER MECHANISM WITH MOMENTARY AUTOMATIC SAFETY

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/869,013

(22) Filed: Sep. 29, 2015

(51) Int. Cl.

| | |
|---|---|
| ***F41A 19/46*** | (2006.01) |
| ***F41A 19/10*** | (2006.01) |
| ***F41A 17/46*** | (2006.01) |
| ***F41A 19/12*** | (2006.01) |

(52) U.S. Cl.
CPC ..... *F41A 19/46* (2013.01); *F41A 17/46* (2013.01); *F41A 19/10* (2013.01); *F41A 19/12* (2013.01)

(58) Field of Classification Search
CPC ..... F41A 19/46; F41A 19/10; F41A 19/12; F41A 19/45; F41A 17/46; F41A 17/48
USPC ..... 89/142, 129.01, 129.02, 132, 139, 140, 89/141, 148, 149, 150, 154; 42/70.01, 42/70.03, 70.04
See application file for complete search history.

(56) References Cited

U.S. PATENT DOCUMENTS

| | | | | |
|---|---|---|---|---|
| 5,760,328 | A * | 6/1998 | Robbins | F41A 19/46 89/129.02 |
| 8,826,798 | B2 * | 9/2014 | Hochstrate | F41A 19/46 89/139 |
| 2007/0180984 | A1 * | 8/2007 | Huther | F41A 17/74 89/148 |
| 2013/0111794 | A1 * | 5/2013 | Dionne | F41A 17/00 42/70.01 |

* cited by examiner

*Primary Examiner* — John D Cooper
(74) *Attorney, Agent, or Firm* — Merchant & Gould, PC

(57) ABSTRACT

In general terms, this disclosure is directed to a trigger mechanism with a mode selector element that is placeable in a safety mode, a semi-automatic fire mode, and a momentary automatic fire mode. In one possible configuration and by non-limiting example, the mode selector element includes a selector block and a handle portion extending from the selector block to allow the selector block to be rotated between the different modes. The mode selector element is configured such that the selector block can be indexed into the safety mode and the fire mode. The mode selector element is additionally configured such that the selector mode is spring biased to automatically rotate from the momentary automatic fire mode to the fire mode when the handle portion is not constrained by a force, such as when an operator releases the handle portion.

9 Claims, 15 Drawing Sheets

TRIGGER MECHANISM WITH MOMENTARY AUTOMATIC SAFETY

BACKGROUND

The firing of a firearm is typically controlled by a trigger mechanism. The trigger mechanism includes a trigger that, when pulled, releases spring-loaded components that initiate the firing sequence. In fully automatic firearms, the trigger mechanism is generally placeable in a safety mode in which the trigger mechanism cannot be operated, a semi-automatic fire mode in which the trigger mechanism can be operated to fire a single round with each pull of the trigger, and an automatic mode in which the trigger mechanism can be operated to fire a plurality of rounds while the trigger is maintained in the pulled position. In some instances a handle or lever is provided to place the firearm in the various modes. In such cases, the firearm will remain in whichever position the operator places the handle or lever until the operator moves the handle or lever to another position. This type of configuration can result in an operator being unaware of the operating mode of the firearm. For example, the operator may fire the firearm in the automatic mode while believing the firearm to be in the fire mode.

SUMMARY

In general terms, this disclosure is directed to a trigger mechanism with a mode selector element that is placeable in a safety mode, a semi-automatic fire mode, and a momentary automatic fire mode. In one possible configuration and by non-limiting example, the mode selector element includes a selector block defining a first detent recess, a second detent recess, and a ramped surface proximate the second detent recess on a side opposite from the first detent recess. The mode selector element can also include a handle portion extending from the selector block and a spring biased detent pin. In one aspect, the selector block is rotatable by the handle portion between a first position or safety position in which the spring biased detent pin is received into the first detent recess, a second position or fire position in which the spring biased detent pin is received into the second detent recess, and a third or momentary automatic fire position in which the spring biased detent pin is engaged with the ramped surface such that the selector block is biased to automatically rotate from the third position to the second position.

The disclosure also is directed to a mode selector element in which the handle portion defines a first engagement surface and a second engagement surface, wherein the first and second engagement surfaces are oriented in a non-parallel relationship with respect to each other. In one example, the first and second engagement surfaces are orthogonal to each other. When the mode selector element is installed in the firearm, the selector block is rotatable by the handle portion between a first position in which the first engagement surface is engaged against the first stop member, a second position, and a third position in which the second engagement surface is engaged against the second stop member.

DETAILED DESCRIPTION

Figure 1:
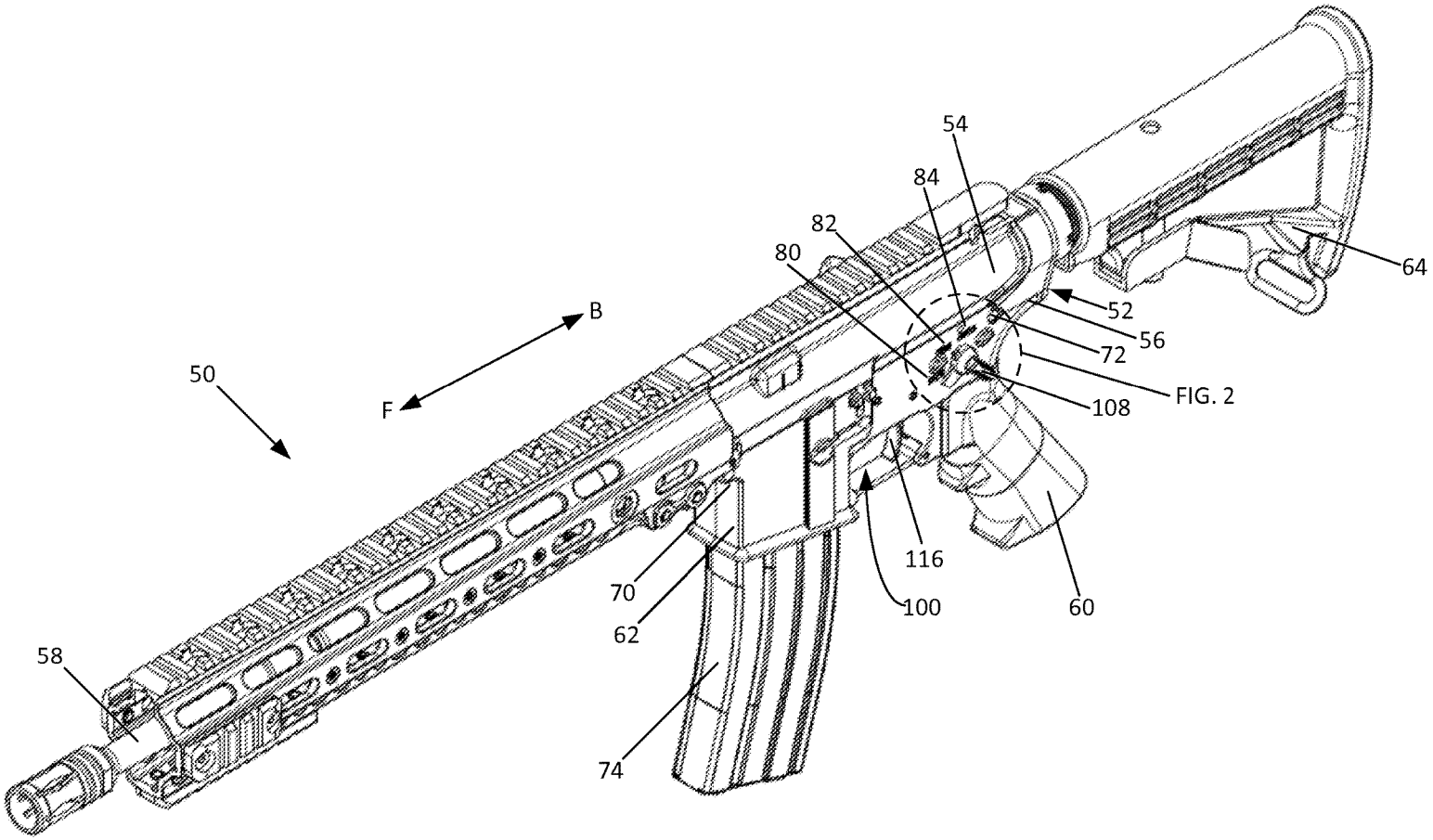
FIG. 1 is a perspective view of an example firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 3:
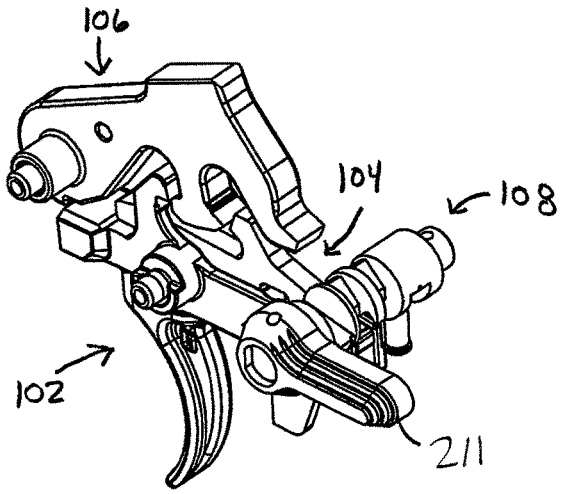
FIG. 3 is a perspective view of an example trigger mechanism of the firearm of FIG. 1, with a mode selector element moved to a first position.
Figure 4:
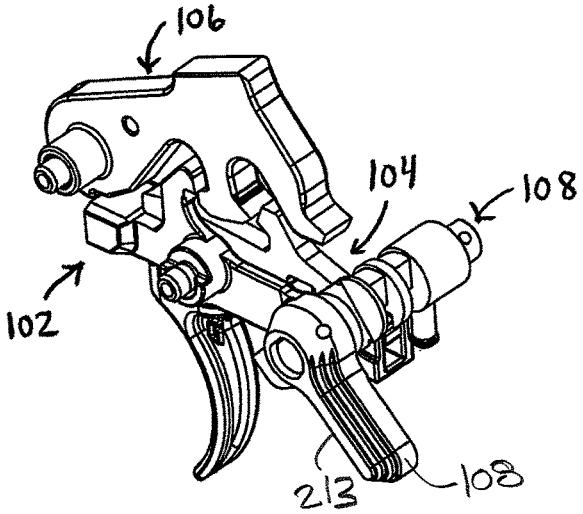
FIG. 4 is a perspective view of an example trigger mechanism of the firearm of FIG. 1, with a mode selector element moved to a second position.

As used herein, the word "front" or "forward" corresponds to the direction opposite to an end of the trigger mechanism where the mode selector element is located (i.e., the left as shown in FIGS. 3, 4, and the right as shown in FIGS. 15-18, 21-24, and 27-30). This direction is the same as the firing direction F of the firearm 100, as illustrated at FIG. 1. As used herein, the word "rear," "rearward," or "back" corresponds to the end of the trigger mechanism where the mode selector element is located (i.e., the right as shown in FIGS. 3, 4, and the left as shown in FIGS. 15-18, 21-24, and 27-30). This direction is illustrated at FIG. 1 as being direction B and is in the opposite direction from the firing direction F.

FIG. 1 is a perspective view of an example firearm 50. The firearm 50 generally includes a receiver body 52 including an upper receiver 54 and a lower receiver 56, a barrel assembly 58, a pistol grip 60, a magazine well 62, a buttstock 64, and a trigger mechanism 100 including a mode selector element 108. Also shown are a pivot pin 70, a takedown pin 72, a magazine 74, and one or more mode selection marks 80, 82 and 84.

The firearm 50 can be of various types. Examples of the firearm 50 include, but are not limited to, handguns, rifles, shotguns, carbines, machine guns, submachine guns, personal defense weapons, automatic rifles, and assault rifles. In at least some embodiments, the firearm 50 is an AR-15, M-16 or M-4 type rifle, or one of their variants.

The receiver body 52 is configured to house a firing mechanism that includes the trigger mechanism 100 (FIG. 2), in which a spring-biased hammer is cocked and then released by a sear upon actuation of a trigger lever 116 of the triggering mechanism 100. The hammer strikes a firing pin carried by a bolt, which in turn is thrust forward to contact and discharge a cartridge loaded in a chamber. A portion of the expanding combustion gases traveling down the barrel is discharged off and used to drive the bolt rearward against a forward biasing force of a recoil spring for automatically ejecting the spent cartridge casing and automatically loading a new cartridge into the chamber from a magazine when the bolt returns forward. In at least one embodiment, the receiver body 52 includes an upper receiver 54 and a lower receiver 56.

The upper receiver 54 defines an internal longitudinally-extending cavity configured to receive a bolt assembly. The bolt assembly is slidably disposed in the cavity for axially reciprocating recoil movement therein. In at least one embodiment, the upper receiver 54 is an AR-15, M-16 or M-4 type upper receiver, or one of their variants.

The lower receiver 56 includes the pistol grip 60, the magazine well 62, and the buttstock 64. The lower receiver 56 defines a cavity therein to receive the trigger mechanism 100. In at least one embodiment, the lower receiver 56 is removably coupled to the upper receiver 54 using the pivot pin 70 and the takedown pin 72.

The barrel assembly 58 is configured to be installed to the receiver body 52 (for example, the upper receiver 54) and operates to provide a path to release an explosion gas and propel a projectile therethrough.

The pistol grip 60 provides a mechanism held by the shooter's hand to orient the hand in a forward, vertical orientation to operate a trigger lever 116.

The magazine well 62 is configured to detachably receive a self-feeding magazine 74 for holding a plurality of cartridges. The magazine 74 is an ammunition storage and feeding device within the firearm 50.

The buttstock 64 provides a means for a shooter to firmly support the firearm 50 and easily aim it by holding the buttstock 64 against his or her shoulder when firing.

The trigger mechanism 100 operates to actuate the firing sequence of the firearm 50 by operating the bolt assembly accommodated in the upper receiver 54 upon actuation of the trigger by the shooter. In at least some embodiments, the trigger mechanism 100 is configured to provide a plurality of modes enabling different operations of the trigger mechanism 100 (including modes 210, 212 and 214 as illustrated in FIG. 7) and enable a shooter to select one of the triggering modes. Examples of the trigger mechanism 100 are illustrated and described in more detail in FIGS. 2-30.

The mode selector element 108 is pivotally supported in the lower receiver 56 and configured to switch the trigger mechanism 100 among the plurality of different trigger modes. As described below, the mode selection marks 80, 82 and 84 are provided on the lower receiver 56 to represent a trigger mode selected and enabled by the mode selector element 108. An example of the mode selector element 108 is illustrated and described along with the trigger mechanism 100 with reference to FIGS. 2-21.

Although a complete firearm 100 is described utilizing the aforementioned components, many configurations for the firearm 100 are possible which may use only some of the aforementioned components and which may also use additional components.

Figure 2:
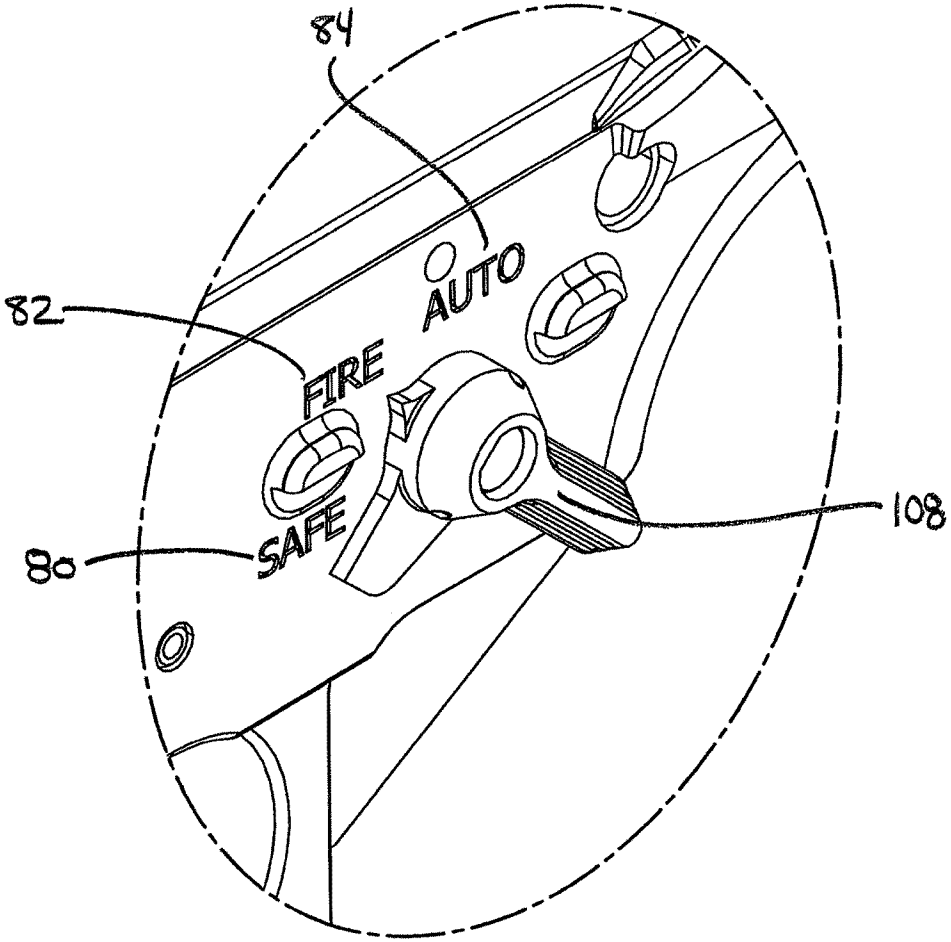
FIG. 2 is a perspective view of an enlarged portion of the example firearm shown in FIG. 1.

FIG. 2 is a perspective view of an enlarged portion of the firearm 50 shown in FIG. 1, including the mode selector element 108 and the mode selection marks 80, 82, 84. As presented, the mode selection mark 80 is associated with a safety mode of operation 210, the mode selection mark 82 is associated with a semi-automatic firing mode of operation 212, and the mode selection mark 84 is associated with an automatic firing mode of operation 214.

Figure 5:
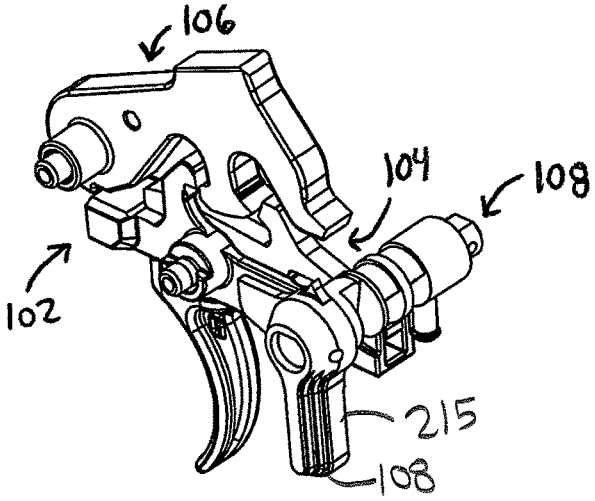
FIG. 5 is a perspective view of an example trigger mechanism of the firearm of FIG. 1, with a mode selector element moved to a third position.

FIG. 3 is a perspective view of an example trigger mechanism 100. In some embodiments, the trigger mechanism 100 includes a trigger element 102, a disconnector 104, a hammer element 106, and a mode selector element 108. As shown, mode selector element 108 is placed in a first position 211 associated with the selection mark 80 and the first mode of operation 210. It is noted that the example trigger mechanism 100 can also be provided with an auto sear element 109, as shown at FIG. 5. The auto sear element 109 is removed from the view shown in FIG. 3 so that the mode selector element 108 can be more easily viewed.

FIG. 4 is a perspective view of the example trigger mechanism 100 shown in FIG. 3, but with the mode selector element 108 placed in a second position 213 associated with the selection mark 82 and the second mode of operation 212. As with FIG. 3, the auto sear element 109 is removed from the view shown in FIG. 4 so that the mode selector element 108 can be more easily viewed.

FIG. 5 is a perspective view of the example trigger mechanism 100 shown in FIG. 3, but with the mode selector element 108 placed in a third position 215 associated with the selection mark 84 and the third mode of operation 214. As with FIG. 3, the auto sear element 109 is removed from the view shown in FIG. 5 so that the mode selector element 108 can be more easily viewed.

Figure 6:
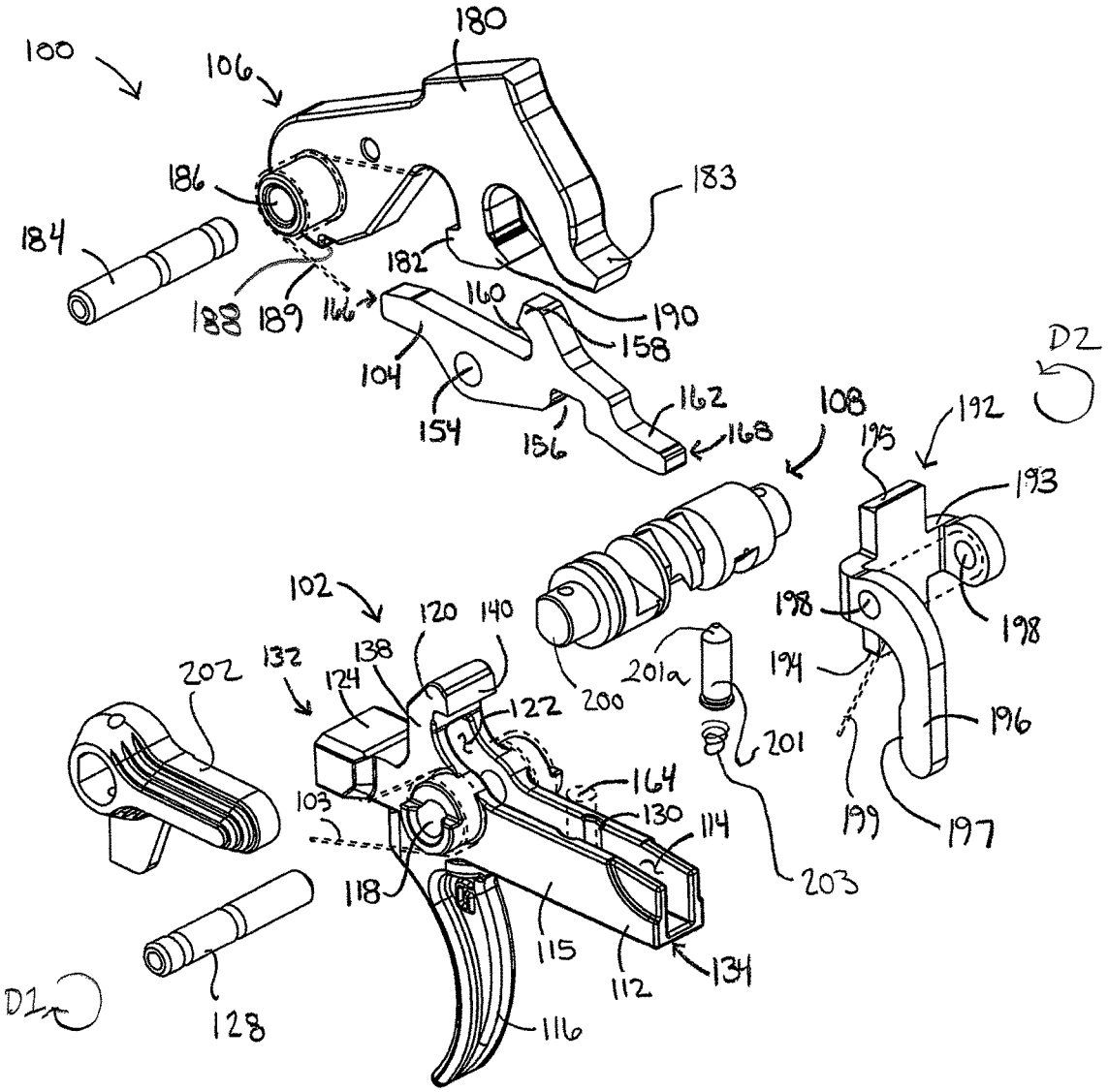
FIG. 6 is an exploded view of the trigger mechanism of FIG. 3.
Figure 7:
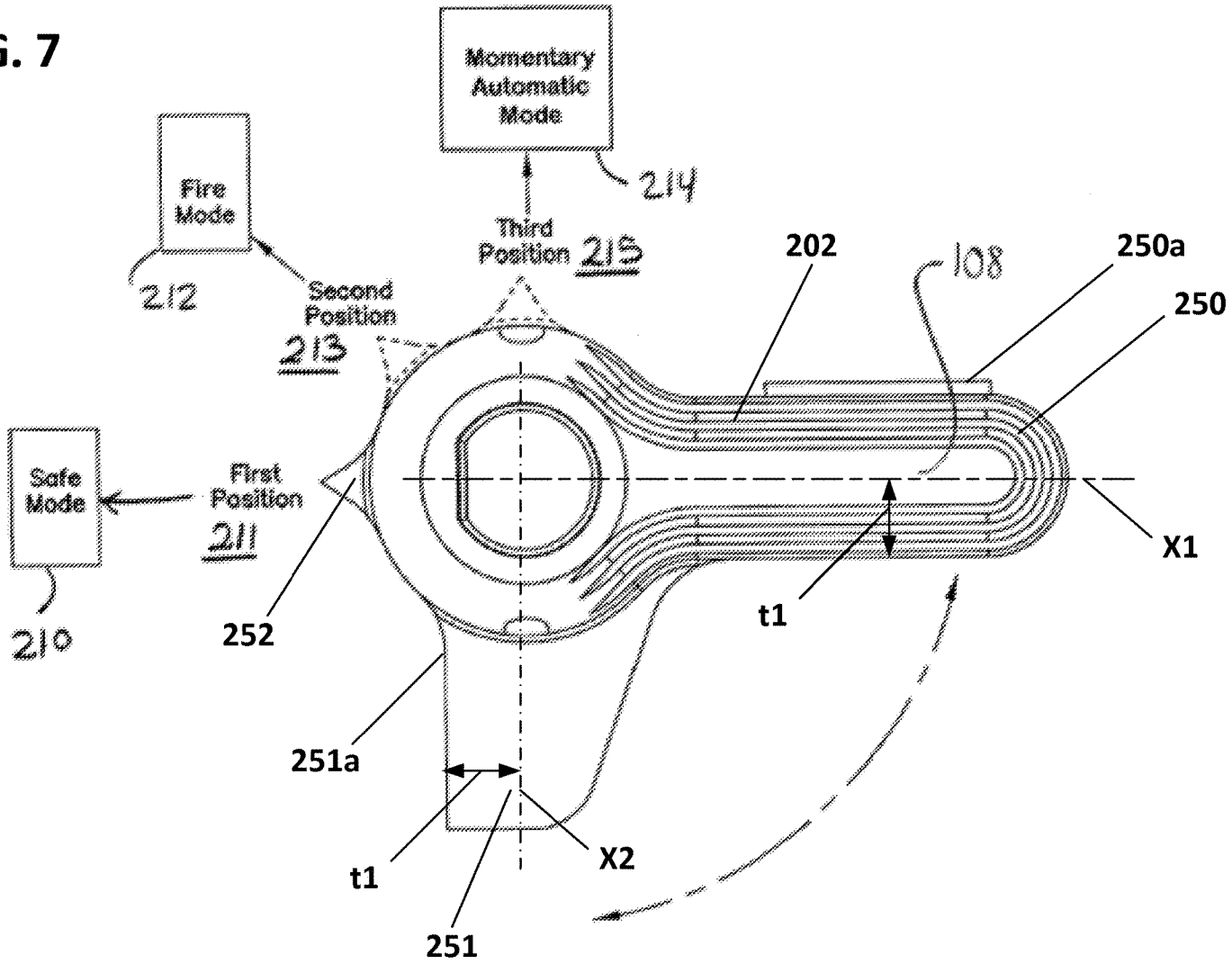
FIG. 7 is a schematic diagram illustrating example trigger modes of the trigger mechanism and corresponding example positions of a mode selector element.

The trigger mechanism 100 is carried by the lower receiver 56 using a trigger pin 128 and a hammer pin 184 (FIG. 6). In the illustrated example at FIG. 5, a trigger element spring and a hammer element spring are omitted so as to not obscure the other components of the trigger mechanism 100. However, when assembled in a firearm both will typically be provided. The trigger element spring provides a force to oppose the trigger pull, and the hammer element spring provides a force to throw the hammer and actuate the bold and firing pin. These springs are shown respectively as springs 103 and 189 in FIG. 6.

As discussed above, FIGS. 3-5 illustrate examples of the trigger element 102, disconnector 104, hammer element 106, and mode selector 108.

The trigger element 102 is pivotally connected to the lower receiver 56 of the firearm 50 and movable between a rest position and a pulled position. The trigger element 102 is configured to interact with the disconnector 104 and the hammer element 106 to operate the hammer element 106 between a cocked position and a released position.

The disconnector 104 is pivotally connected to the trigger element 102 and configured to interact with the trigger element 102 and the hammer element 106 to operate the hammer element 106 between the cocked position and the released position.

The hammer element 106 is configured to pivot between the cocked position and the released position such that the hammer element 106 strikes a firing pin of a bolt assembly as it moves from the cocked position to the released position.

The mode selector element 108 is pivotally supported in the lower receiver 56 of the firearm 50 and interacts with the disconnector 104 to select one of multiple triggering modes. An example structure and operation of the mode selector element 108 is illustrated and described in more detail below.

FIG. 6 is an exploded view illustrating another example of the trigger mechanism 100 of FIGS. 2-5. As described above, in some embodiments, the trigger mechanism 100 includes the trigger element 102, the disconnector 104, the hammer element 106, the mode selector element 108, and the auto sear element 109.

In some embodiments, the trigger element 102 includes a trigger body 112 defining a trough 114, a trigger lever 116, a trigger pin receptacle 118, a trigger sear 120, and a trigger aperture 122. Also shown are a trigger cam surface 124, a trigger pin 128, and one or more spring placements 130.

The trigger body 112 extends between a forward trigger end 132 and a rearward trigger end 134 and is pivotally supported within the lower receiver 56 by the trigger pin 128 passing through the trigger pin receptacle 118. The trigger body 112 is biased by a trigger element spring 103 that is engaged between the trigger body 112 and the lower receiver 56. The trigger body 112 is biased in the rotational direction D1 (i.e., clockwise) opposite to a rotational direction in which the trigger lever 116 is pulled to actuate the trigger mechanism 100 (i.e., counterclockwise).

The trough 114 is defined in the trigger body 112 and configured to receive at least a portion of the disconnector 104. In at least one embodiment, the trough 114 is defined by opposing lateral walls (e.g., a first lateral wall 115 and a second lateral wall 117) at least partially extending along the trigger body 112. The disconnector 104 is pivotally supported within the trough 114 by the trigger pin 128. The trough 114 has one or more placements for one or more disconnector springs 164.

The trigger lever 116 extends from the trigger body 112 and is configured to be actuated by a shooter's finger to fire the firearm 50 (FIG. 1). The trigger body 112 pivots against the biasing force generated by the trigger element spring 103 as the trigger lever 116 is actuated in the rearward direction. In at least one embodiment, the trigger lever 116 is integrally formed with the trigger body 112.

The trigger pin receptacle 118 is formed in the trigger body 112 to receive the trigger pin 128 so that the trigger pin 128 passes therethrough. The trigger pin receptacle 118 is configured to receive the trigger pin 128 to pivotally connect the trigger element 102 relative to the lower receiver 56 of the firearm 50. In at least one embodiment, the trigger pin receptacle 118 includes a pair of holes that are formed on opposing sides of the trigger body 112 and aligned with pin hole 154 of the disconnector 104. As such, the trigger pin 128 passes through one of the holes formed at one side (e.g., the first lateral wall 115) of the trigger body 112, the pin opening hole 154 of the disconnector 104, and the other hole formed at the other side (e.g., the second lateral wall 117) of the trigger body 112.

The trigger sear 120 extends upwardly from the trigger body 112 and includes a leg or extension portion 138 and a hook portion 140. The leg portion 138 extends from opposing side surfaces of the trigger body 112, and the hook portion 140 is disposed on a distal end of the leg portion 138. It should be noted that while the trigger sear 120 is shown extending from a top of the trigger body 112, in alternative embodiments, the trigger sear 120 can extend from any suitable portion of the trigger body 112, such as from a front of the trigger body 112 or from a point adjacent the hook portion 140 (e.g. cantilevered from lateral wall 115 or 117).

The trigger aperture 122 is defined by the trigger sear 120 and open to the trough 114. The trigger aperture 122 allows the disconnector 104 to pass through and under the trigger sear 120 so that the disconnector 104 pivotally operates under the trigger sear 120.

The trigger cam surface 124 is arranged at the forward trigger end 132 of the trigger body 112 and configured to engage the hammer element 106 for allowing the disconnector 104 to interface with a hammer cam surface 188 of the hammer element 106 for holding the hammer element 106 as necessary.

The trigger pin 128 is configured to pivotally support the trigger element 102 and the disconnector 104.

The spring placement 130 is defined in the trough 114 of the trigger body 112 to support the disconnector spring 164.

With continued reference to FIG. 6, the disconnector 104 pivots on the trigger pin 128 and bears on the surface of the trigger pin 128. In at least one embodiment, the disconnector 104 includes a pin hole 154, a spring seat 156, a disconnector contact surface 158, a disconnector catch 160, and a disconnector leg 162. Also shown is a disconnector spring 164.

The disconnector 104 extends from a forward disconnector end 166 and a rearward disconnector end 168, and is received in the trough 114 of the trigger element 102 with the forward disconnector end 166 and the rearward disconnector end 168 adjacent the forward trigger end 132 and the rearward trigger end 134.

The pin hole 154 is configured to receive the trigger pin 128 such that the disconnector 104 is pivotally supported by the trigger pin 128.

The spring seat 156 is configured to support one end of the disconnector spring 164 while the other end supported by the spring placement 130 in the trough 114.

The disconnector contact surface 158 is configured to selectively contact a hammer tongue 190 of the hammer element 106 during a first trigger pulling stage in a two-stage trigger mode.

The disconnector catch 160 is configured to catch the hammer tongue 190 of the hammer element 106 as the hammer element 106 returns to the cocked position after firing.

The first disconnector leg 162 is arranged at the rearward disconnector end 168 and configured to selectively interact with a selector block 200 of the mode selector element 108.

With continued reference to FIG. 6, the hammer element 106 includes a hammer body 180, a hammer sear 182, an auto sear surface 183, a hammer pin 184, a hammer pin receptacle 186, a hammer cam surface 188, and a hammer tongue 190.

The hammer body 180 is pivotally supported by the hammer pin 184 within the lower receiver 56 of the firearm 50. In other embodiments, the hammer body 180 can be pivotally supported in other manners. The hammer body 180 is spring loaded by a hammer element spring 189.

The hammer sear 182 is configured to engage the trigger sear 120 in a cocked position. In the cocked position, the hammer sear 182 is fully engaged in the trigger sear 120. Pulling the trigger lever 116 causes the trigger element 102 and the disconnector 104 to rotate about the trigger pin 128 and pull the trigger sear 120 off the hammer sear 182. For example, when the trigger element 102 is in the rest position, the trigger sear 120 is engaged with the hammer sear 182 and holds the hammer element 106 in the cocked position. When the trigger element 102 is in the pulled position, the hammer sear 182 is released from the trigger searl 120.

The hammer pin 184 is used to pivotally support the hammer body 180 relative to the lower receiver 56 of the firearm 50. The hammer body 180 pivots on the hammer pin 184 and bears on the surface of the hammer pin 184.

The hammer pin receptacle 186 is formed through the hammer body 180 and configured to receive the hammer pin 184.

The hammer cam surface 188 is configured to interact with the trigger cam surface 124 to provide a secondary safety sear function. For example, when the trigger sear 120 disengages the hammer sear 182 accidentally (i.e. without the trigger lever 116 being pulled rearward), the trigger cam surface 124 engages the hammer cam surface 188 to prevent the hammer element 106 from being activated by the hammer element spring 189. The trigger cam surface 124 and the hammer cam surface 188 come into contact with each other due to the trigger lever 116 being in the forward position.

The hammer tongue 190 is arranged to be opposite to the hammer sear 182 and configured to either engage the contact surface 158 and/or the first disconnector catch 160 of the disconnector 104.

The actuator assembly 126 includes an auto sear assembly 192 including a main body 193. The main body 193 has a first catch surface 194 for engaging with the auto sear surface 183 of the hammer body 180 in an automatic firing mode as long as the trigger 116 is held in the fire position. This timing occurs before the hammer sear 182 can engage with the disconnector catch 160, thereby removing the need to pull the trigger 116 to fire individual rounds. The main body 193 also has a engagement surface 195 which is configured to contact a bolt assembly (not shown in FIG. 6) of the firearm 50, such that forward axial movement of bolt assembly during a firing cycle sequence of a firearm (e.g. firearm 50) is converted into a force that causes the main body 193 to rotate and disengage the surface 194 from the surface 183 to release the hammer 106. The main body 193 also includes an arm 196 having a contact surface 197. The auto sear assembly 192 is pivotally mounted in the lower receiver 56 by a pin (not shown) extending through apertures 198. Accordingly, the main body 193 rotates about an axis concentric with the apertures 198. A spring 199 is provided to bias the auto sear assembly 192 such that the contact surface 197 of the arm 196 is brought into contact with a surface of the selector block 200. A variety of configurations of the actuator assembly can exist, and the depicted embodiment is meant to only illustrate a single example of an actuator assembly.

With continued reference to FIG. 6, the mode selector element 108 includes a selector block 200, a selector lever 202, a selector coupler (not shown in FIG. 6), a detent pin 201, and a spring 203 for biasing the detent pin 201 against the selector block 200.

The mode selector element 108 is rotatably supported by the lower receiver 56 of the firearm 50 (FIG. 1). In at least one embodiment, the mode selector element 108 is arranged adjacent the rearward trigger end 134 of the trigger body 112. The mode selector element 108 is rotatable to select a plurality of different modes, as illustrated in FIG. 7.

The selector block 200 is configured to selectively engage the disconnector 104 and the auto sear assembly 192. The selector block 200 operates to switch between multiple operational modes. An example of the selector block 200 is illustrated and described in more detail with reference to FIGS. 8-12.

The selector lever 202 is attached to the selector block 200 to rotate the selector block 200 between different operational modes. As shown in FIG. 1, the selector lever 202 is exposed at the lower receiver 56 of the firearm 50 so that a user rotates the selector lever 202 to change the position of the selector block 200. As described below, for example, the selector lever 202 can be rotated in three different positions, such as a first position 211, a second position 213, and a third position 215 (FIG. 7). In some embodiments, the first, second, and third positions 211, 213, 215 are spaced apart by 45 degrees. For example, the selector lever 202 is directed rearwards in the first position, rearwards and downwards in the second position, and downwards in the third position.

The selector coupler (not shown in FIG. 6) is used to couple the selector lever 202 to the selector block 200. In other embodiments, the selector lever 202 can be attached to the selector block 200 in other manners, such as welding and adhesive. In yet other embodiments, the selector lever 202 can be formed integrally with the selector block 200.

FIG. 7 is a schematic diagram illustrating example trigger modes of an example of the trigger mechanism 100 and corresponding example positions of the mode selector element 108. As depicted, the trigger mechanism 100 can operate in three different trigger modes: a safe mode 210, a semi-automatic fire mode 212, and a fully automatic mode 214. The three different modes 210, 212, and 214 are interchangeable by changing a position of the mode selector element 108 into one of three positions 211, 213, and 215.

In the safe mode 210, the trigger mechanism 100 is prevented from releasing the hammer element 106 and thus prevented from accidental discharge of the firearm 50. In at least one embodiment, the mode selector element 108 is in a first position 211 (e.g., a safe position) to implement the safe mode 210, thereby blocking the disconnector 104 from pivoting around the trigger pin 128 to release the hammer element 106. In at least one embodiment, when the mode selector element 108 is arranged in the first position 211, the selector lever 202 of the mode selector element 108 is arranged to extend rearwards (to the right from the view of FIG. 1).

In the fire mode 212, the trigger mechanism 100 allows the trigger to be operated in a semi-automatic firing operation by moving the auto sear assembly 192 and the disconnector 104 via the selector block 200 such that the auto sear surface 183 of the hammer 180 cannot engage with the catch surface 194 of the auto sear assembly 192. This ensures that the hammer 180 rotates further back such that the hammer tongue 190 engages with the disconnector catch 160 (if trigger is held in fire position) and the hammer sear 182 engages with the disconnector catch 160 (once trigger is released) after each round is fired. Accordingly, this action requires the trigger 116 to be released before a subsequent round can be fired in this mode. The mode selector element 108 is arranged in a second position 213 to implement the semi-automatic fire mode 212. In at least one embodiment, when the mode selector element 108 is in the second position 213, the selector lever 202 of the mode selector element 108 is arranged to extend rearwards and downwards from the view of FIGS. 1-2 and 7.

In the momentary automatic mode 214, the trigger mechanism 100 allows the trigger to be operated in an automatic firing operation by moving the auto sear assembly 192 such that the auto sear surface 183 of the hammer 180 engages with the catch surface 194 of the auto sear assembly 192 as long as the trigger lever 116 is held in the fire position. The mode selector element 108 is arranged in a third position 215 to implement the momentary automatic mode 214. As explained in greater detail below, the selector block 200 is spring biased towards the second position 213 such that the selector lever 202 must be actively held in the third position 215 to maintain the firearm 50 in the momentary automatic mode 214. Release of the selector lever 202 will result in the selector block 200 automatically rotating into the second position 213 associated with the semi-automatic fire mode 212. In at least one embodiment, when the mode selector element 108 is in the third position 215, the selector lever 202 of the mode selector element 108 is arranged to extend downwards, as shown in FIGS. 1-2 and 7.

As illustrated, the first, second, and third positions 211, 213, and 215 can be spaced apart by 45 degrees. In other embodiments, the three positions 211, 213, and 215 can be apart in different increments.

Figure 8:
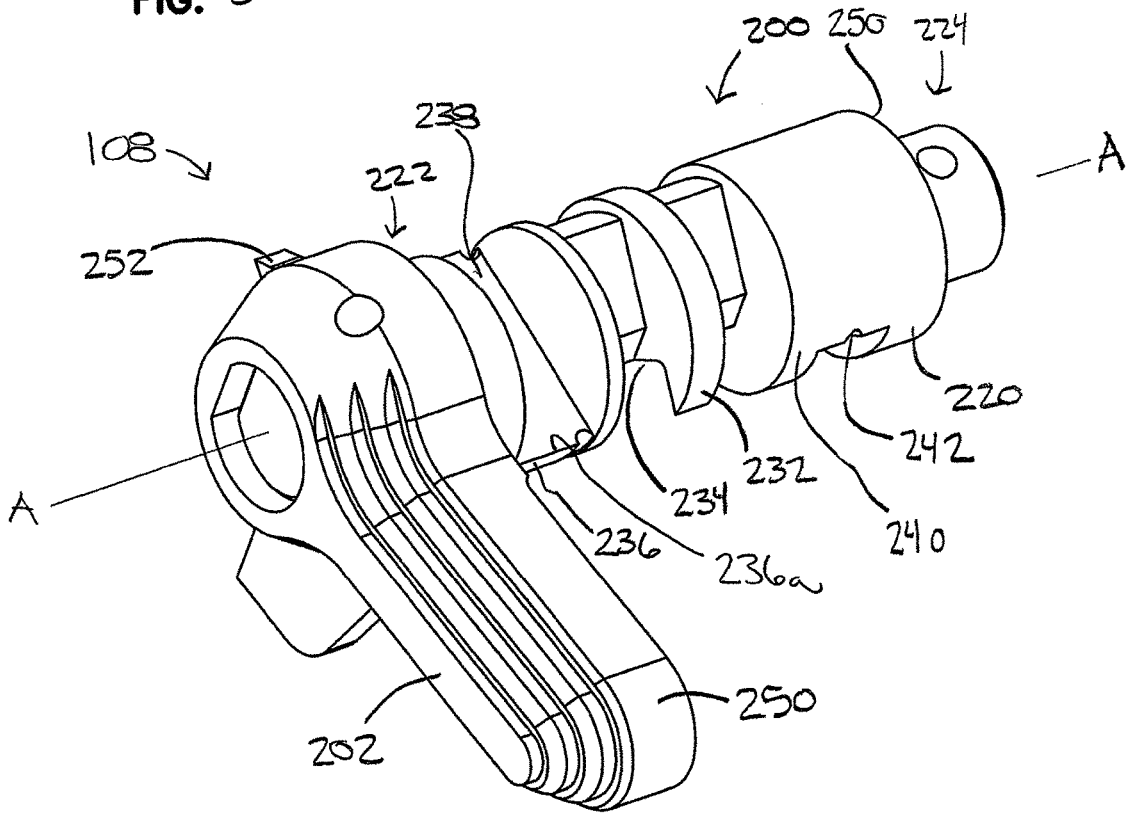
FIG. 8 is a perspective view of an example mode selector element.
Figure 9:
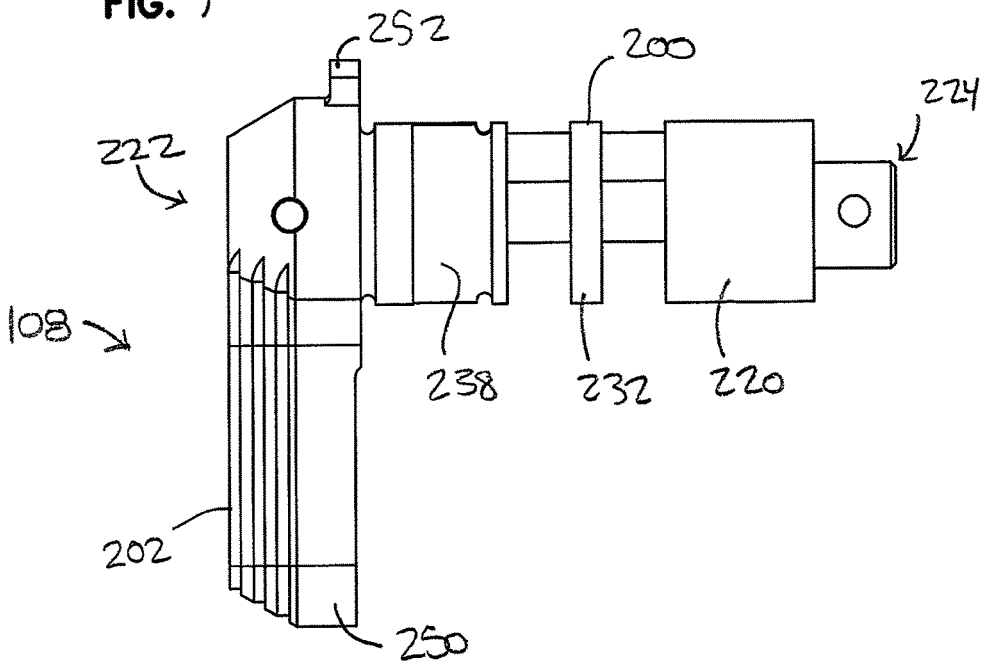
FIG. 9 is a top view of the mode selector element of FIG. 8.
Figure 10:
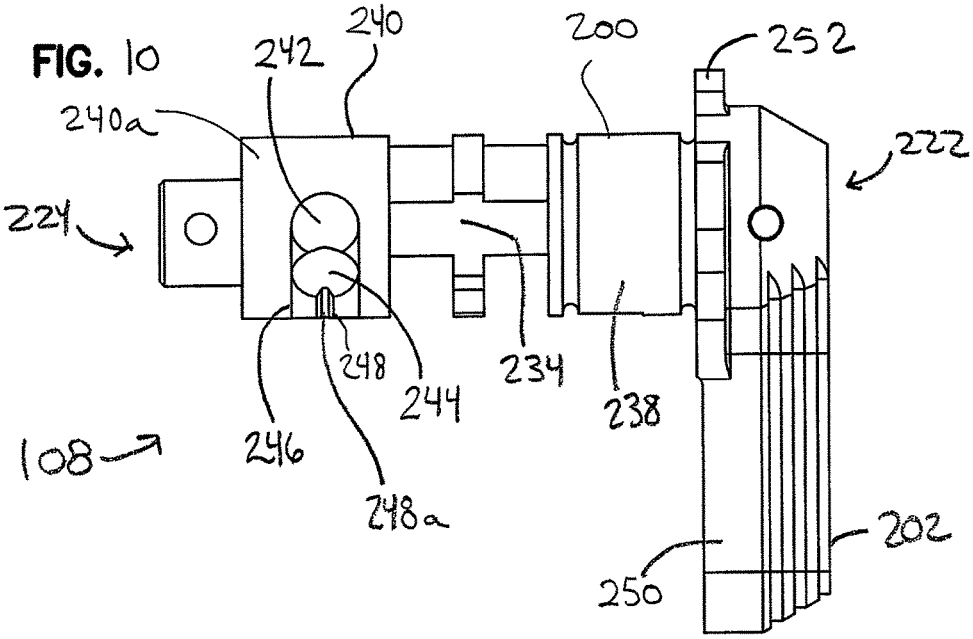
FIG. 10 is a bottom view of the mode selector element of FIG. 8.
Figure 11:
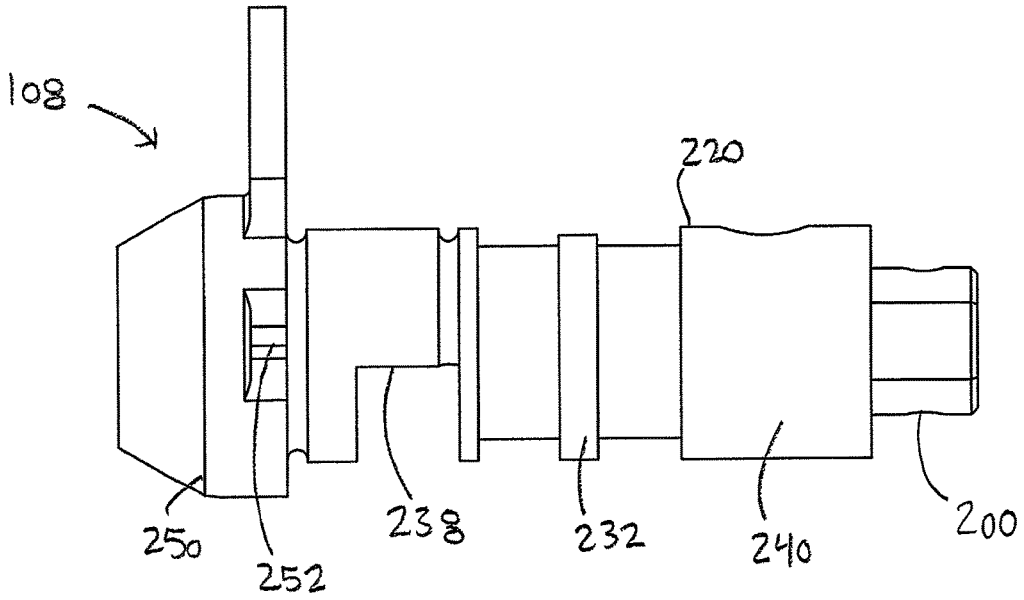
FIG. 11 is a front view of the mode selector element of FIG. 8.
Figure 12:
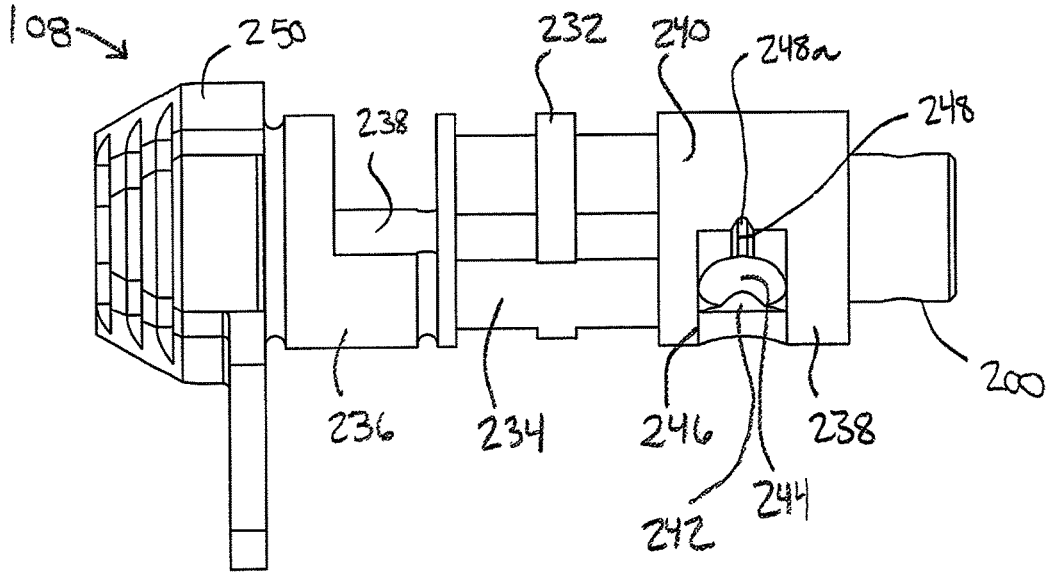
FIG. 12 is a rear view of the mode selector element of FIG. 8.

Referring to FIGS. 8-12, an example mode selector element 108 is described in more detail. In particular, FIG. 8 is a perspective view of an example mode selector element 108, FIG. 9 is a top view of the mode selector element 108 of FIG. 8, FIG. 10 is a bottom view of the mode selector element of FIG. 8, FIG. 11 is a front view of the mode selector element 108 of FIG. 8, and FIG. 12 is a rear view of the mode selector element of FIG. 8.

As illustrated, the mode selector element 108 includes the selector block 200, the selector lever 202, and the selector coupler (not shown in FIG. 7). In some embodiments, the selector coupler is a keyed pin that extends through the selector lever 202 and the selector block 200.

The selector block 200 is configured to rotate about an axis of rotation A relative to the lower receiver 56 of the firearm 50. In at least one embodiment, the selector block 200 is generally a cylindrical body 220 extending between a first block end 222 and a second block end 224 along the axis of rotation A.

The selector block 200 rotates along the axis of rotation A to selectively interact with the disconnector leg 162 of the disconnector 104 and the arm 196 of the auto sear assembly 192. When the mode selector element 108 is in the first position 211 (e.g., the safe mode 210), the selector block 200 engages the disconnector leg 162 to prevent a movement of the disconnector 104. When the mode selector element 108 element is in the second position 213 (e.g., the semi-automatic firing mode 212), the selector block 200 disengages with the disconnector leg 162 to allow a movement of the disconnector 104, and thus the trigger lever 116. In this position, and as discussed above, the selector block 200 also engages the arm 196 to ensure that the first catch surface 194 cannot engage with the auto sear surface 183. When the mode selector element 108 is actively held by an operator in the third position 215 (e.g., associated with the momentary automatic firing mode 214), the selector block 200 further engages the arm 196 at contact surface 197 to position the first catch surface 194 in an engageable position with the auto sear surface 183 and to position the engagement surface 195 in an engageable position with the bolt. In this position, and as long as the trigger is held in the fire position, the main body 193 can rotate between a first position in which the hammer 106 is held back by engagement between the first catch surface 194 and the auto sear surface 183 and a second position in which the hammer is released. The hammer is released by virtue of the bolt contacting the engagement surface 195 during the forward action of the bolt. This causes the main body 193 to rotate forward (counterclockwise in direction D2, FIG. 6) to disengage the first catch surface 194 from the auto sear surface 183.

In at least one embodiment, the selector block 200 includes a first stopper portion 232 and an associated first slot portion 234, and a second stopper portion 236 and an associated second slot portion 238. The selector block 200 also includes a third portion 240 which defines a first detent recess 242, a second detent recess 244, and a guide channel 246 within which the first and second detent recesses 242, 244 are disposed. The guide channel includes a sliding ramp surface 248 extending beyond the second detent 244. The detent recesses 242, 244 allow the position of the selector block 200 to be indexed by receiving the detent pin 201.

The first stopper portion 232 is configured to engage the disconnector leg 162 to disable the movement of the disconnector 104 when the mode selector element 108 is in the first position 211 (FIGS. 13-18). The first stopper portion 232 is shaped to limit the movement of the disconnector leg 162 within a predetermined range that disables a triggering operation of the trigger mechanism 100. In at least one embodiment, as illustrated in FIG. 7, the first stopper portion 232 is substantially flush with an outer surface of the cylindrical body 220. In other embodiments, the first stopper portion 232 can have various shapes, such as grooves, insofar as the first stopper portion 232 engages the disconnector leg 162 to disable the pivoting movement of the disconnector 104.

The second stopper portion 236 is configured to engage the contact surface 197 of the auto sear assembly arm 196 when the mode selector element 108 is in the first position 211 (FIGS. 13-18). The above described position of the auto sear assembly 192 when the mode selector element 108 is in the first or safety position 211 is effectuated by this engagement. As the mode selector element 108 is rotated from the first position and into the second position 213 (FIGS. 19-24), the body 220 rotates such that the arm contact surface 197 is engaged against the intersection 236*a* between the second stopper portion 236 and the second slot portion 238. The above described position of the auto sear assembly 192 when the mode selector element 108 is in the second or fire position 213 is effectuated by this engagement. As the mode selector element 108 is further rotated from the second position 213 and into the third or momentary automatic position 215 (FIGS. 25-30), the body 220 rotates such that the second stopper portion 236 completely disengages from the arm contact surface 197. This allows the arm 196 to rotate within the recessed area defined by the second slot portion 238. Accordingly, the main body 193 can rotate in a reciprocating fashion as described above for automatic operation.

The third portion 240 is configured with a first detent recess 242 which is aligned on the body 220 to receive the detent pin 201 when the mode selector element 108 is moved into the first position 211 (FIGS. 13-18). The detent pin 201 is urged into the detent recess 242 by a biasing spring 203 such that a threshold force must be applied to the handle portion 250 to force the detent pin 201 out of the first detent recess 242. Accordingly, once the mode selector element 108 is moved into the first position 211, the detent arrangement of the recess 242 and pin 201 will retain the mode selector element 108 in this position until a sufficient force is applied to the handle portion 250. To facilitate easier engagement and disengagement, the detent pin 201 can be provided with a tip 201*a* having an angled or curved surface, for example a conical or domed shape surface.

The third portion 240 is additionally configured with a second detent recess 244 which is aligned on the body 220 to receive the detent pin 201 when the mode selector element 108 is moved into the second position 213 (FIGS. 19-24). The detent pin 201 is urged into the detent recess 244 by the biasing spring 203 such that a threshold force must be applied to the handle portion 250 to force the detent pin 201 out of the second detent recess 244. Accordingly, once the mode selector element 108 is moved into the second position 213, the detent arrangement of the recess 244 and pin 201 will retain the mode selector element 108 in this position until a sufficient force is applied to the handle portion 250.

The third portion 240 is additionally configured with a sliding ramped surface 248 that is located within the channel 246 adjacent the second detent recess 244 and on an opposite side from the first detent recess 242. The sliding ramped surface 248 can be provided with a groove 248*a* having a profile generally matching that of the tip portion 201*a* of the detent pin 201. The sliding ramped surface 248 is ramped at an angle to match that of the pin tip 201*a*. When the mode selector element 108 is moved past the second position 213 and towards the third position 215, there is no third detent recess into which the pin 201 can be received to hold the mode selector element 108 in the third position 215, as is the case with typical fully automatic firearms. Rather, the tip 201*a* of the pin 201 travels along the ramped surface groove 248*a* during rotation towards the third position 215. As groove 248*a* is ramped, the spring 203 becomes compressed as the mode selector element 108 is moved towards the third position 215. As the pin 201 is imparting a force (by virtue of the compression of the spring 203) onto the groove 248*a* as the mode selector element 108 is rotated toward the third position, a biasing rotational force is imparted onto the selector block 200 back towards the second position 213. Accordingly, when a user releases the handle portion 250 when the mode selector element 108 is at the third position 215, or at any point between the second and third positions 213, 215, the mode selector element 108 will automatically rotate back to the second position 213 until the pin 201 is received into the second detent recess 244.

With continued reference to FIGS. 8-12, the selector lever 202 includes a handle portion 250 and a mode indicator 252.

The handle portion 250 is configured to radially extend from the axis of rotation A and provides a grip to allow a user to rotate the selector block 200 between the first, second and third positions 211, 213 and 215.

The mode indicator 252 is used to indicate one or more marks 80, 82 and 84 (FIG. 1) that represent different trigger modes (e.g., the safe mode 210, the fire mode 212, and the momentary automatic mode 214). The marks 80, 82 and 84 are provided on an outer surface of the lower receiver 56 of the firearm 50. For example, a first mark 80 can read "SAFE," a second mark 82 can read "FIRE," and a third mark 84 can read "AUTO." In at least one embodiment, the mode indicator 252 is arranged opposite to the handle portion 250.

Referring now to FIGS. 13-18, an example operation of the trigger mechanism 100 is illustrated and described in more detail. For clarity purposes, some of the components, such as the disconnector spring 164, the trigger element spring, the hammer element spring 189, are not illustrated.

Figure 13:
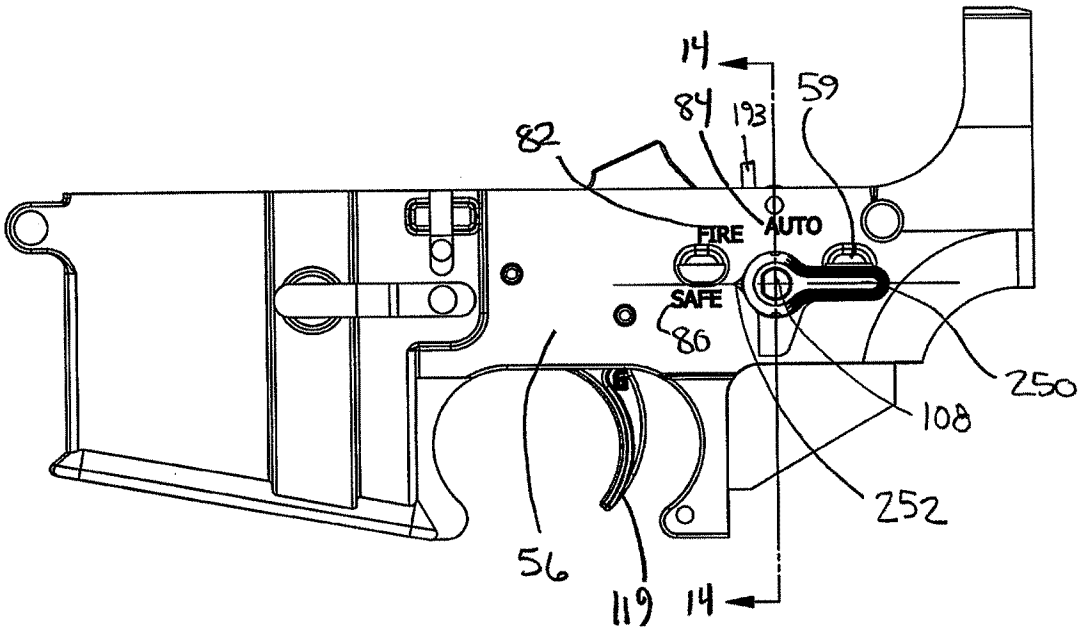
FIG. 13 is a side view of the lower receiver and trigger assembly of the firearm shown in FIG. 1, with the mode selector element moved to the first position.

FIG. 13 schematically illustrates an example operation of the trigger mechanism 100 in the safe mode 210. In the safe mode 210, the mode selector element 108 is in the first position 211 at which the handle portion 250 of the selector lever 202 extends rearward (to the right from the view of FIG. 13) and the mode indicator 252 is directed forward (to the left from the view of FIG. 13). In other embodiments, other orientations of the mode selector element 108 (e.g., the handle portion 250 and/or the mode indicator 252) in the safe mode are possible. FIG. 13 also shows the lower receiver 56 as having a first stop member 59. The first stop member 59 engages against an engagement surface 250*a* (FIG. 7) on the lever handle portion 250 once the mode selector element 108 has reached the first position 211. The contact between the engagement surface 250*a* and the first stop member 59 prevents the handle portion 250 and the selector block 200 from rotating beyond the first position 211.

Figure 14:
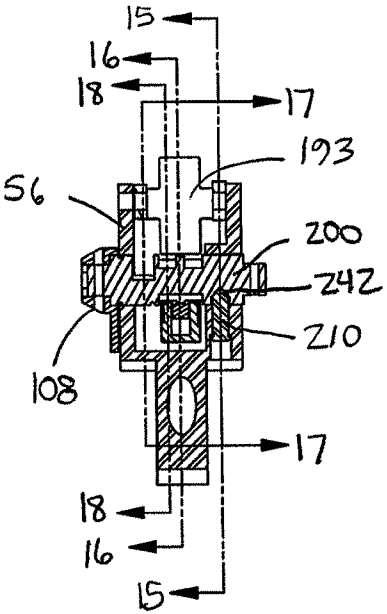
FIG. 14 is a cross-sectional view of the lower receiver and trigger assembly of the firearm shown in FIG. 1, taken along the line 14-14 in FIG. 13.

FIG. 14 shows a section of the trigger mechanism 100 taken along the line 14-14 shown in FIG. 13. FIG. 14 shows that the selector block 200 extends completely across the width of the lower receiver 56 with the selector lever 202 adjacent a sidewall of the lower receiver. The pin 201, travelling within the channel 246, also works to retain the selector block 200 within the lower receiver 56.

Figure 16:
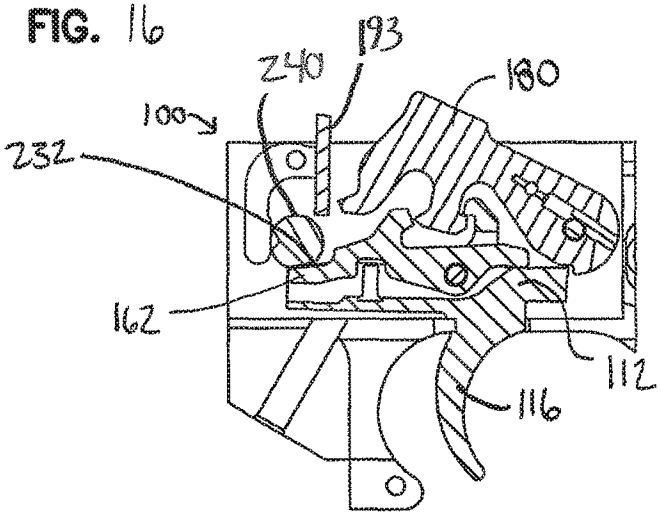
FIG. 16 is a cross-sectional view of the lower receiver and trigger assembly of the firearm shown in FIG. 1, taken along the line 16-16 in FIG. 14.
Figure 15:
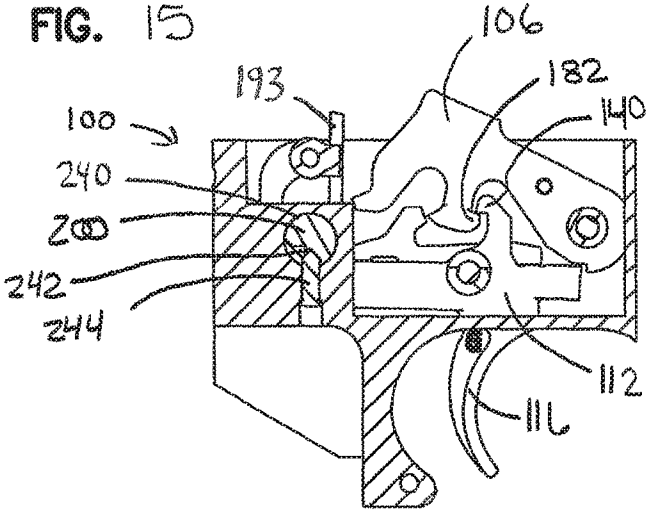
FIG. 15 is a cross-sectional view of the lower receiver and trigger assembly of the firearm shown in FIG. 1, taken along the line 15-15 in FIG. 14.
Figure 18:
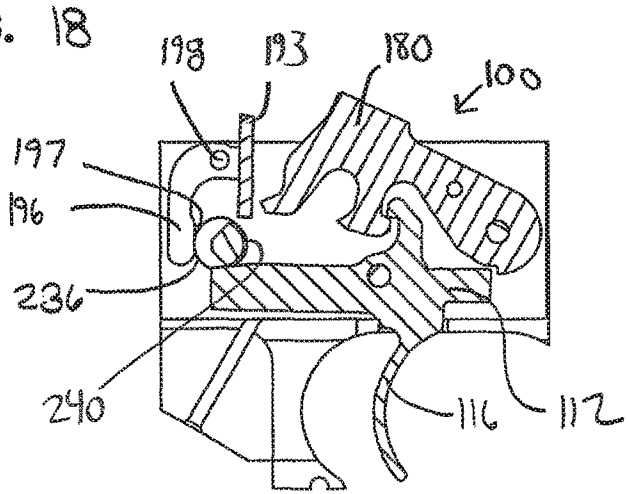
FIG. 18 is a cross-sectional view of the lower receiver and trigger assembly of the firearm shown in FIG. 1, taken along the line 18-18 in FIG. 14.
Figure 17:
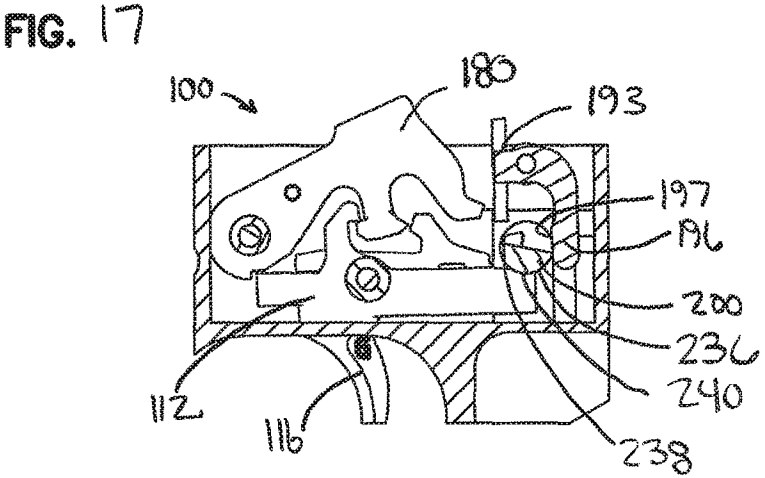
FIG. 17 is a cross-sectional view of the lower receiver and trigger assembly of the firearm shown in FIG. 1, taken along the line 17-17 in FIG. 14.

FIGS. 15-18 show cross-sectional views of the trigger mechanism 100 in which FIG. 15 is taken along the line 15-15 in FIG. 14, FIG. 16 is taken along the line 16-16 in FIG. 14, FIG. 17 is taken along the line 17-17 in FIG. 14, FIG. 18 is taken along the line 18-18 in FIG. 14. FIG. 15 shows that the pin 201 has been fully received into the first detent recess 242. As discussed previously, this action maintains the selector block 200 in the first position 211 by virtue of the force exerted on the pin 201 by the spring 203. FIG. 15 also shows that the hook portion 140 is engaged with the hammer sear 183. FIG. 16 shows the first stopper portion 232 engaged with the disconnector leg 162 to stop the disconnector 104 from pivoting around the trigger pin 128. Accordingly, the hammer element 106 is locked in the cocked position and the trigger element 102 cannot be pulled enough to actuate the trigger mechanism 100. FIGS. 17 and 18 show the second stopper portion 236 engaged against the contact surface 197 of the auto sear assembly arm 196 to ensure that the main body 193 is held away from the hammer 106.

Figure 19:
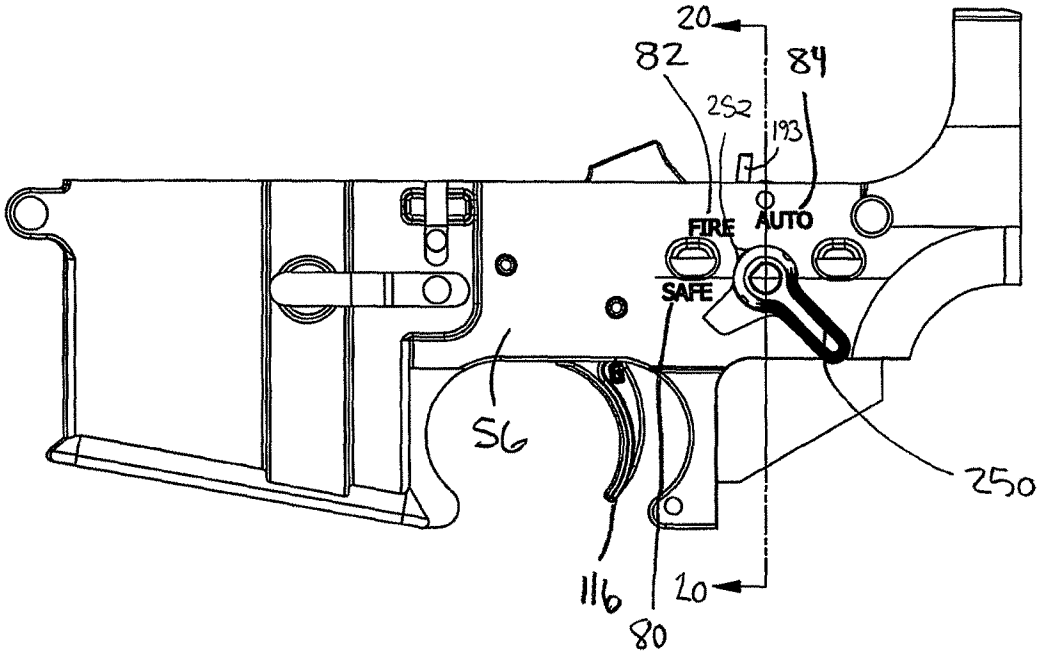
FIG. 19 is a side view of the lower receiver and trigger assembly of the firearm shown in FIG. 1, with the mode selector element moved to the second position.

FIG. 19 schematically illustrates an example operation of the trigger mechanism 100 in the fire mode 212. In the fire mode 212, the mode selector element 108 is in the second position 213 at which the handle portion 250 of the selector lever 202 extends rearward and downward (to the right and down from the view of FIG. 19) and the mode indicator 252 is directed forward and upward (to the left and up from the view of FIG. 19). In other embodiments, other orientations of the mode selector element 108 (e.g., the handle portion 250 and/or the mode indicator 252) in the fire mode are possible.

Figure 20:
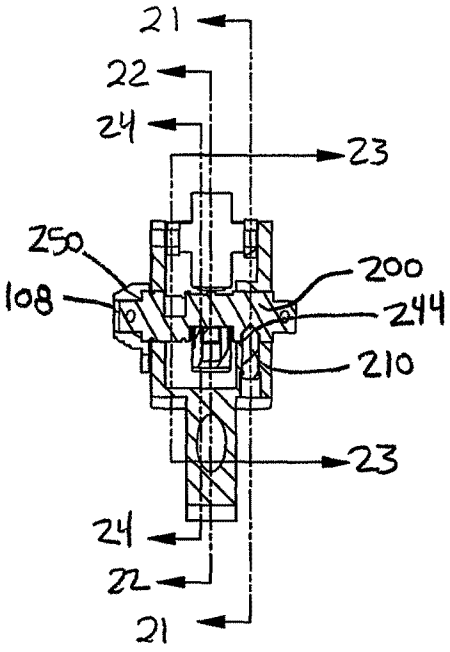
FIG. 20 is a cross-sectional view of the lower receiver and trigger assembly of the firearm shown in FIG. 1, taken along the line 20-20 in FIG. 19.
Figure 22:
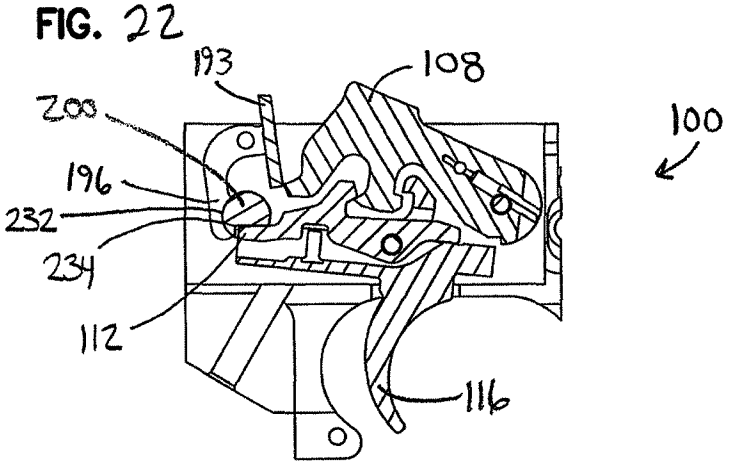
FIG. 22 is a cross-sectional view of the lower receiver and trigger assembly of the firearm shown in FIG. 1, taken along the line 22-22 in FIG. 20.
Figure 21:
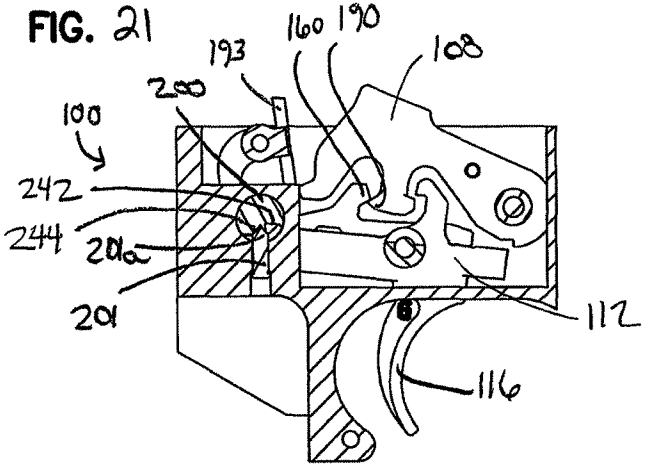
FIG. 21 is a cross-sectional view of the lower receiver and trigger assembly of the firearm shown in FIG. 1, taken along the line 21-21 in FIG. 20.
Figure 24:
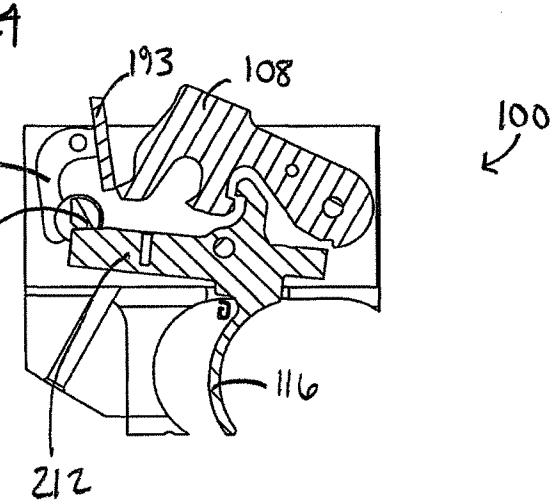
FIG. 24 is a cross-sectional view of the lower receiver and trigger assembly of the firearm shown in FIG. 1, taken along the line 24-24 in FIG. 20.
Figure 23:
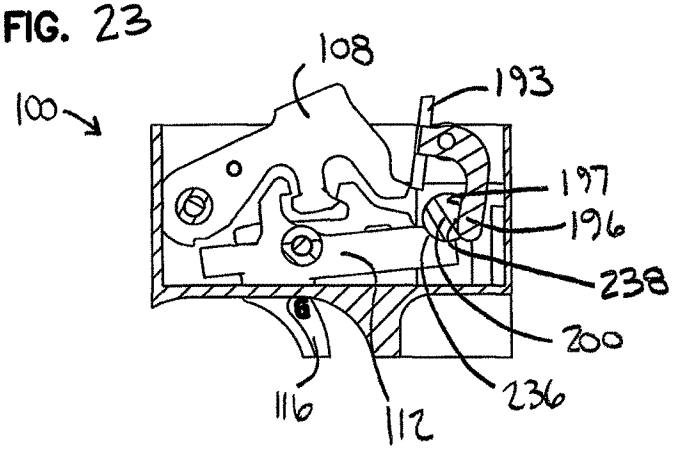
FIG. 23 is a cross-sectional view of the lower receiver and trigger assembly of the firearm shown in FIG. 1, taken along the line 23-23 in FIG. 20.

FIG. 20 shows a section of the trigger mechanism 100 taken along the line 20-20 shown in FIG. 19. FIG. 20 also shows multiple demarcation lines for the cross-sectional views of FIGS. 21-24. FIGS. 21-24 show cross-sectional views of the trigger mechanism 100 in which FIG. 21 is taken along the line 21-21 in FIG. 20, FIG. 22 is taken along the line 22-22 in FIG. 20, FIG. 23 is taken along the line 23-23 in FIG. 20, FIG. 24 is taken along the line 24-24 in FIG. 20. FIG. 21 shows that the pin 201 has been fully received into the second detent recess 244. As discussed previously, this action maintains the selector block 200 in the second position 213 by virtue of the force exerted on the pin 201 by the spring 203. FIG. 21 also shows that the disconnector catch 160 is engaged with the hammer tongue 190. FIG. 22 shows the selector block 200 having been rotated such that the disconnector leg 162 is disengaged from the first stopper portion 232 and instead rests against the first slot portion 234 by virtue of the trigger 116 being held in the fire position. Were the operator to release the trigger 116 from this position, the trigger body 112 would rotate by the force of spring 103, thereby causing the disconnector catch 160 to disengage from the hammer tongue 190 and causing the hammer sear 182 to engage with the hook portion 140. FIGS. 23 and 24 show the second stopper portion 236 disengaged from the contact surface 197 of the auto sear assembly arm 196 whereby the force of spring 199 rotates the auto sear assembly arm 196 against the second slot portion 238.

FIG. 19 schematically illustrates an example operation of the trigger mechanism 100 in the fire mode 212. In the fire mode 212, the mode selector element 108 is in the second position 213 at which the handle portion 250 of the selector lever 202 extends rearward and downward (to the right and down from the view of FIG. 19) and the mode indicator 252 is directed forward and upward (to the left and up from the view of FIG. 19). In other embodiments, other orientations of the mode selector element 108 (e.g., the handle portion 250 and/or the mode indicator 252) in the fire mode are possible.

Figure 25:
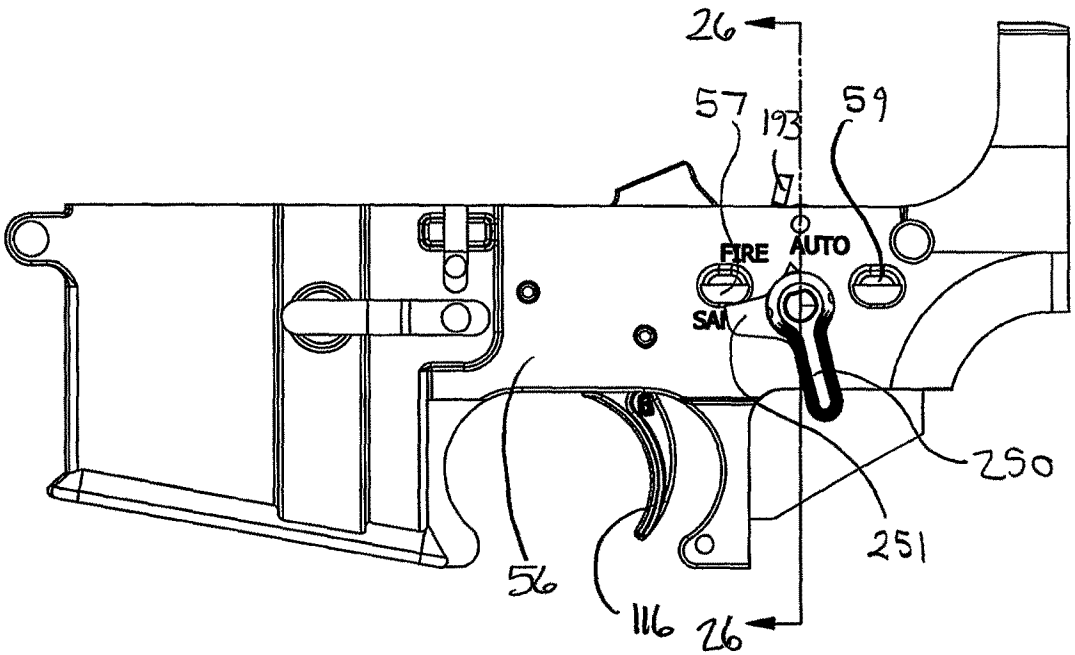
FIG. 25 is a side view of the lower receiver and trigger assembly of the firearm shown in FIG. 1, with the mode selector element having been moved to the start of the third position.

FIG. 25 schematically illustrates an example operation of the trigger mechanism 100 in the momentary automatic mode 214. In the momentary automatic mode 214, the mode selector element 108 is in the third position 215 at which the handle portion 250 of the selector lever 202 extends downward (down from the view of FIG. 25) and the mode indicator 252 is directed upward (up from the view of FIG. 25). In other embodiments, other orientations of the mode selector element 108 (e.g., the handle portion 250 and/or the mode indicator 252) in the momentary automatic mode are possible.

Figure 25A:
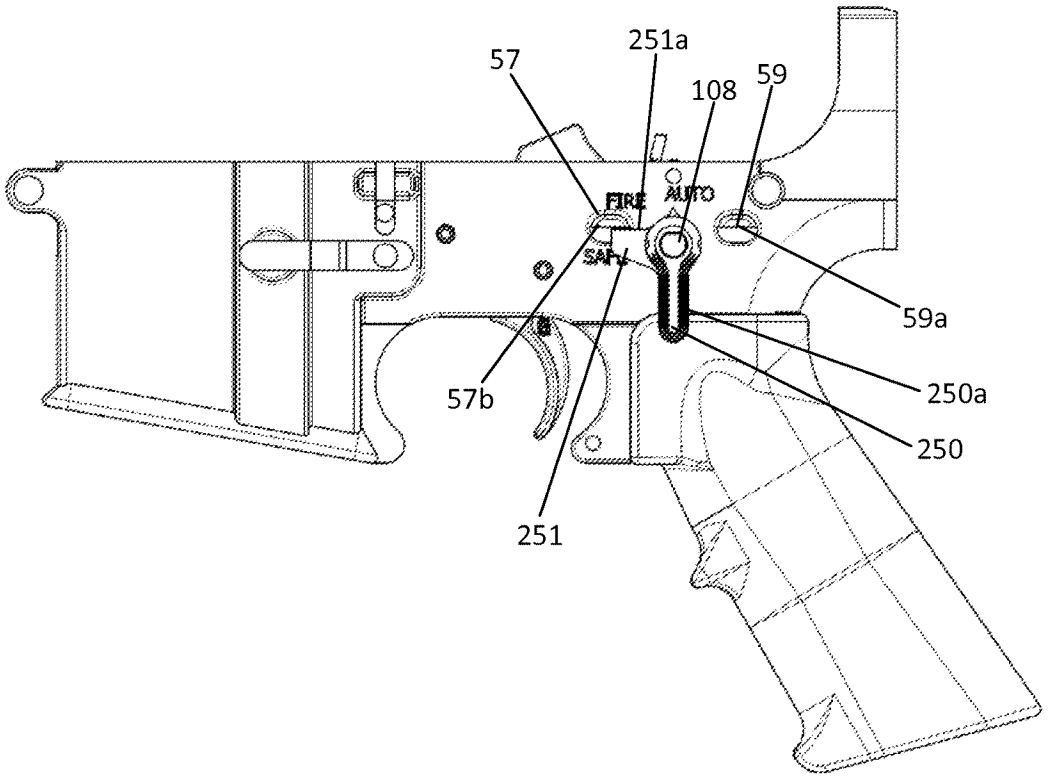
FIG. 25A is a side view of the lower receiver and trigger assembly of the firearm shown in FIG. 1, with the mode selector element having been moved to the end of the third position.

FIG. 25 additionally shows that the selector lever 202 can be provided with a second engagement surface 251*a* configured for engagement with a stop member 57 on the lower receiver 56. As shown, the second engagement surface 251*a* is defined as an edge surface of a generally planar wing 251 extending from the handle portion 250. However, many other configurations are possible for defining a contact point between the lever 202 and the stop member 57. The second engagement surface 251*a* operates to prevent the selector block 200 from being rotated past the third position 215. It is noted that the momentary automatic mode 214 is engaged once the mode selector element 108 is placed in the position shown at FIG. 25 and will remain in this mode even as the mode selector element 108 is further rotated until the second engagement surface 251*a* engages with the flat surface 57*a* of the stop member 57, as shown at FIG. 25A. In the example shown, the momentary automatic mode 214 is engaged when the longitudinal axis X1 of the lever handle portion 250 is at any orientation between about 75 degrees (FIG. 25) and about 90 degrees (FIG. 25A) below horizontal (left right on the page—parallel to X1 on FIG. 7).

It is noted that the disclosed trigger mechanism 100, which includes mode selector element 108, can be fitted onto an existing firearms. Some fully automatic firearms have stop members 57, 59 provided at locations that allow a standard lever handle to rotate through 180 degrees between a safe mode (0 degrees) and a fully automatic mode (180 degrees). By providing the second engagement surface 251, the total degrees of rotation through which the lever handle 250, and thus the selector block 200, must rotate to move through the first, second, and third positions can be fully manipulated. As explained above, the first, second, and third positions are spaced apart by 45 degrees, thus resulting in a total rotation of the handle 250 and selector block 200 of about 90 degrees. This is accomplished by arranging the second arrangement surface 251*a* to be orthogonal (i.e. 90 degrees) to the first engagement surface 250*a*. Proper positioning is also accomplished by offsetting the second engagement surface 251*a* forward a distance t1 from an axis X2, which can be defined as passing through the longitudinal axis A of the selector block and being aligned with the third position. This distance t1 is the same as half the thickness of the handle portion 250, which is the defining variable for the location of the stop member 57. As can be appreciated by the disclosure, the relative angle between the first and second engagement members 250*a*, 251*a* can be defined to provide any desired rotational angle between the first and third positions that is less than 180 degrees (i.e. any non-parallel angle) when used with stop members 57, 59 placed in standard locations.

FIG. 25A shows that the stop member 57 has a flat surface 57*a* that is collinear with and parallel to a flat surface 59*a* of the stop member 59. The first engagement surface 250*a*, which is simply the side edge of the handle portion 250 abuts the flat surface 59*a* when the handle portion 250 is rotated to place the mode selector 108 in the safe mode of operation.

The first second engagement surface 251*a* abuts the flat surface 57*a* when the handle portion 250 is rotated 90 degrees from the safe mode of operation and into the furthest allowed position in the fully automatic mode of operation.

Figure 26:
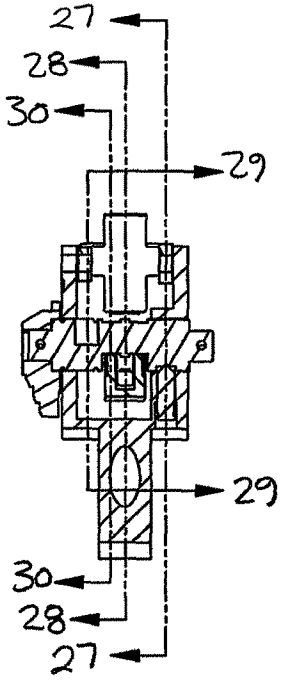
FIG. 26 is a cross-sectional view of the lower receiver and trigger assembly of the firearm shown in FIG. 1, taken along the line 25-25 in FIG. 25.
Figure 28:
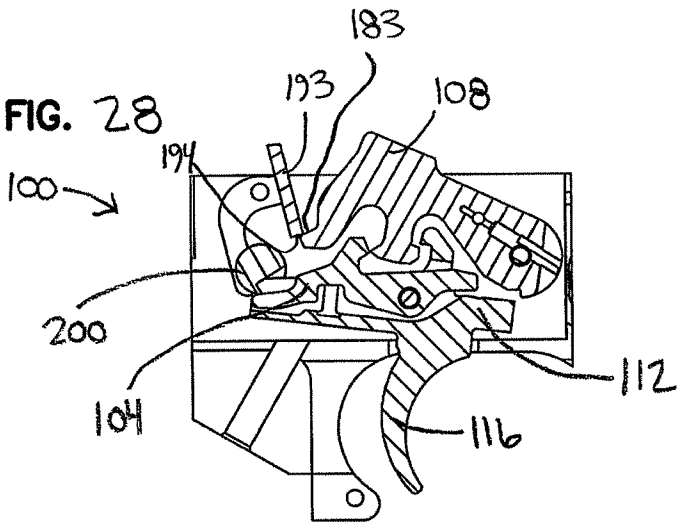
FIG. 28 is a cross-sectional view of the lower receiver and trigger assembly of the firearm shown in FIG. 1, taken along the line 28-28 in FIG. 26.
Figure 27:
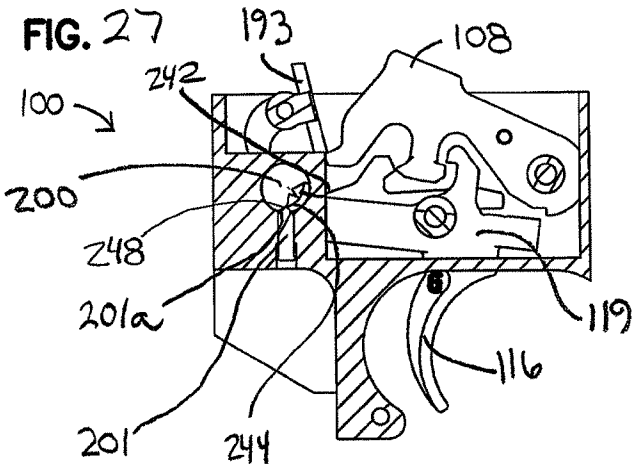
FIG. 27 is a cross-sectional view of the lower receiver and trigger assembly of the firearm shown in FIG. 1, taken along the line 27-27 in FIG. 26.

FIG. 26 shows a section of the trigger mechanism 100 taken along the line 26-26 shown in FIG. 25. FIG. 26 also shows multiple demarcation lines for the cross-sectional views of FIGS. 25-28. FIGS. 25-28 show cross-sectional views of the trigger mechanism 100 in which FIG. 25 is taken along the line 25-25 in FIG. 26, FIG. 26 is taken along the line 26-26 in FIG. 26, FIG. 27 is taken along the line 27-27 in FIG. 26, FIG. 28 is taken along the line 28-28 in FIG. 26.

Figure 30:
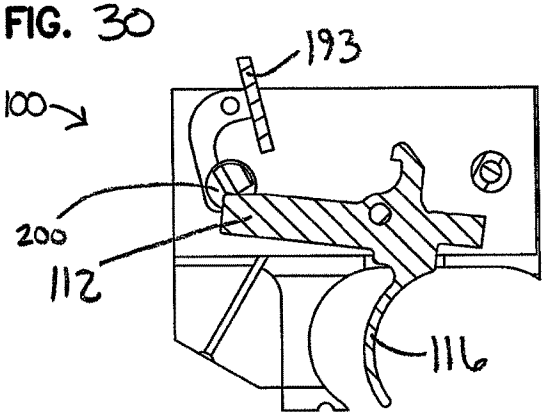
FIG. 30 is a cross-sectional view of the lower receiver and trigger assembly of the firearm shown in FIG. 1, taken along the line 30-30 in FIG. 26.
Figure 29:
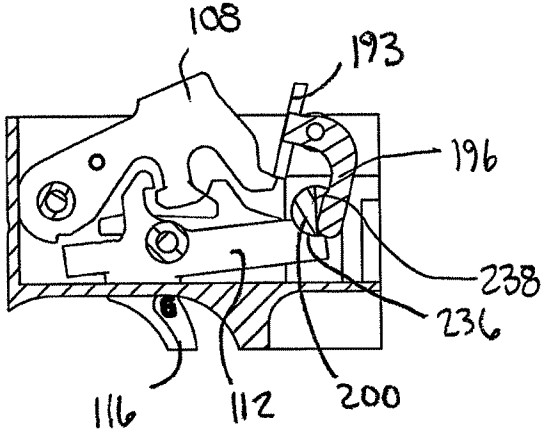
FIG. 29 is a cross-sectional view of the lower receiver and trigger assembly of the firearm shown in FIG. 1, taken along the line 29-29 in FIG. 26.

FIG. 27 shows that the selector block 200 has been rotated such that the pin 201 has lifted out of the second detent recess 244 and against the ramped surface 248. As discussed previously, the tip 201*a* of the pin 201 is provided with an angled surface that engages with the ramped surface 248. As shown, the tip 201*a* angled surface is parallel to the ramped surface 248. In this configuration, the upward (when viewed at FIG. 27) force exerted by the pin 201, by virtue of the spring 203, onto the ramped surface 248 in turn exerts a rotating force onto the selector block 200 in a clockwise direction (when viewed at FIG. 27) back towards the second position 213. As no detent is present to hold the selector block 200 in the third position, the selector block 200 will automatically rotate back into the second position as soon as an operator releases the handle portion 250. It is noted that the selector block 200 may also be provided with a biasing spring to augment or replace this function of the spring 203. FIG. 28 shows the auto sear assembly catch surface 194 engaged with the hammer auto sear surface 183 with the trigger 116 being retained in the fire position. FIGS. 29 and 30 show the auto sear assembly 192 enabled to reciprocate back and forth by virtue of the selector block 200 being rotated such that the arm 196 can travel within the are defined by the second slot portion 238 in a known manner.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A mode selector element for a trigger mechanism having a spring bias, the mode selector element comprising:

a selector block defining a first detent recess, a second detent recess, and a ramped surface proximate the second detent recess on a side opposite from the first detent recess; and a selector lever extending from the selector block;

wherein the selector block is rotatable by the selector lever among a first position in which the first detent recess is configured to receive the spring bias, a second position in which the second detent recess is configured to receive the spring bias, and a third position in which the ramped surface is configured to engage the spring bias such that the selector block is biased to automatically rotate from the third position to the second position; and wherein the first position corresponds to a safety mode of the trigger mechanism, the second position corresponds to a firing mode of the trigger mechanism, and the third position corresponds to an automatic firing mode of the trigger mechanism.

2. The mode selector element of claim 1, wherein the selector lever comprises a handle portion and a wing portion oriented in a non-parallel relationship to the handle portion, the handle portion being configured to engage with a first stop member of a firearm in which the trigger mechanism is installed when the selector block is in the first position, the wing portion being configured to engage with a second stop member of the firearm when the selector block is in the third position.

3. The mode selector element of claim 1, wherein the selector lever is mechanically fastened to the selector block.

4. The mode selector element of claim 1, wherein the selector block has a first surface arrangement for engaging a disconnector of the trigger mechanism and a second surface arrangement for engaging an auto sear assembly of the trigger mechanism.

5. A trigger mechanism for a firearm comprising the mode selector element of claim 1 and a spring bias.

6. The trigger mechanism of claim 5, wherein the spring bias comprises a detent pin having a tip portion and a spring urging the detent pin in a direction towards the tip portion.

7. The trigger mechanism of claim 6, wherein the tip portion comprises an angled surface.

8. The trigger mechanism of claim 7, wherein when the selector block is rotated into the third position the angled surface is in contact with and parallel to the ramped surface of the selector block.

9. A firearm comprising the trigger mechanism of claim 5.

* * * * *